United States Patent [19]

Nolte

[11] 3,967,360

[45] July 6, 1976

[54] PNEUMATIC JACK DEVICE

[75] Inventor: Ted W. Nolte, Safford, Ariz.

[73] Assignee: Lawrence Peska Associates, Inc., New York, N.Y. ; a part inerest

[22] Filed: July 1, 1975

[21] Appl. No.: 592,279

[52] U.S. Cl. ..... 29/252; 254/93 HP

[51] Int. Cl.[2] ..... B25B 27/14

[58] Field of Search ..... 9/311, 329, 340, 341, 9/342; 29/252; 254/93 HP

[56] References Cited

UNITED STATES PATENTS

| | | | |
|---|---|---|---|
| 665,924 | 1/1901 | McGee | 9/340 |
| 1,212,315 | 1/1917 | Bjerre | 9/340 |
| 1,367,225 | 2/1921 | Barker | 9/340 |

FOREIGN PATENTS OR APPLICATIONS

| | | | |
|---|---|---|---|
| 442,876 | 12/1948 | Italy | 9/340 |
| 98,813 | 4/1923 | Switzerland | 9/340 |

*Primary Examiner*—James L. Jones, Jr.
*Attorney, Agent, or Firm*—Richard E. Nanfeldt

[57] ABSTRACT

A pneumatic jack device is used to extract an agitator from the tube of a washing machine. The device includes an annular split ring member having a pair of closed ends and a chamber therein, wherein the member expands into a split toroidial configuration. A valve extends inwardly through an opening in the annular member, wherein the valve is adapted to receive a pneumatic pressurized line. A mechanism is provided for holding together the closed ends of the annular split member during inflation into the split toroidial configuration.

1 Claim, 2 Drawing Figures

PNEUMATIC JACK DEVICE

BACKGROUND OF THE INVENTION

U.S. Pat. No. 3,026,521 employs a pneumatic lifter for a bed patient which is of an elongated rectangular shape.

U.S. Pat. No. 3,346,885 employs an air lift mattress for use in a bath tub, wherein the mattress is of an elongated rectangular shape.

U.S. Pat. No. 3,822,861 employs an inflatable form breaker for molded construction, wherein a rectangular shaped member is inflated into an ellipsoidal configuration.

These aforementioned devices are not capable of fitting under the shoulder of an agitator of a washing machine for use as a pneumatic jack device.

SUMMARY OF THE INVENTION

My present invention relates to a unique and novel pneumatic jack device used to extract an agitator from the tub of a washing machine.

An object of my present invention is to provide a pneumatic jack device used to lift an agitator from the tub of a washing machine.

A further object of my present invention is to provide a device which will fit under the annular shoulder of the agitator of a conventionally styled washing machine.

Briefly, my present invention comprises an annular split ring member having a pair of closed ends and a chamber therein, wherein the member expands into a split toroidial configuration. A valve extends inwardly through an opening in the annular member, wherein the valve is adapted to receive a pneumatic pressurized line. A mechanism is provided for holding together the closed ends of the annular split member during inflation into the split toroidial configuration.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
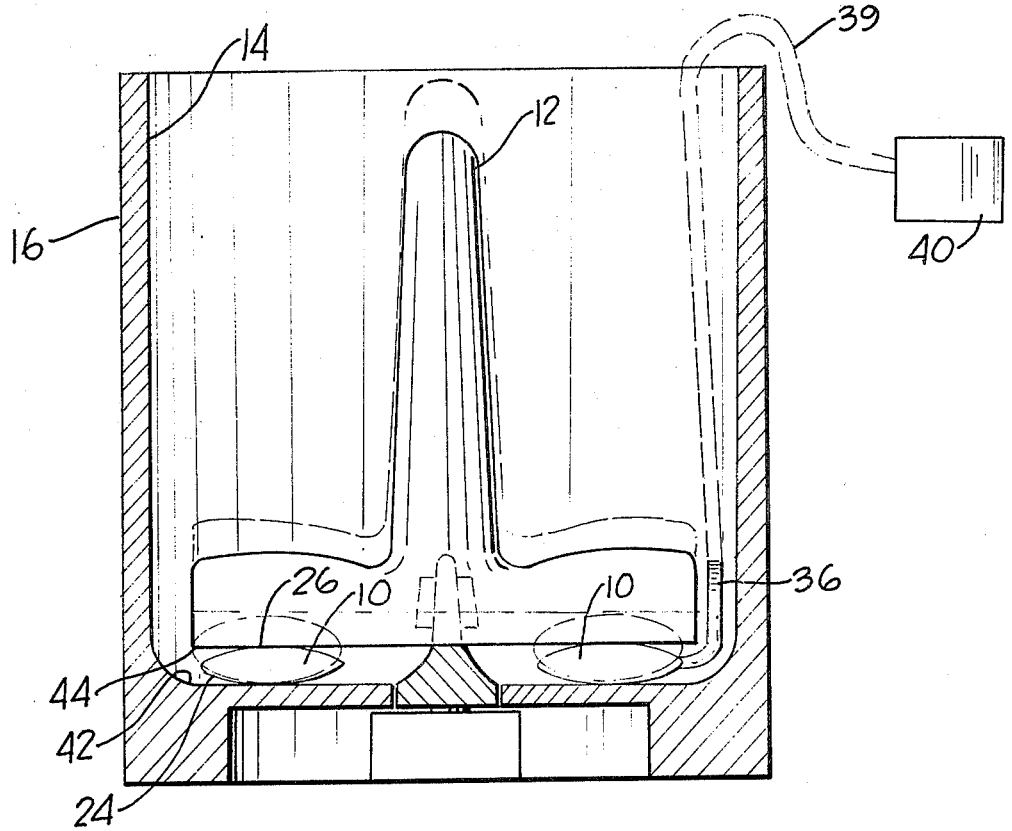
FIG. 1 illustrates a side cross sectional view of a pneumatic jack device engaging and lifting an agitator within the tub of a washing machine.
Figure 2:
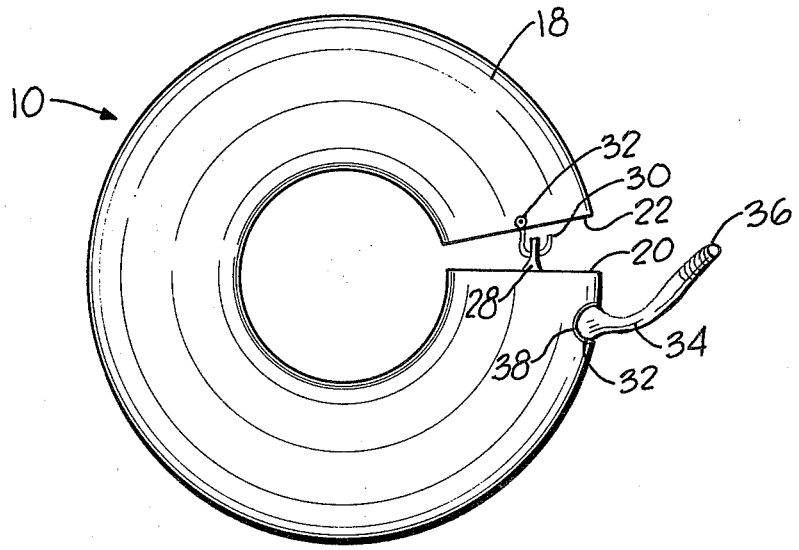
FIG. 2 illustrates a top planar view of the pneumatic jack device.

Turning now descriptively to the drawings, in which similar reference characters denote similar elements throughout the several views, FIGS. 1–2 show a pneumatic jack device 10 used as a means for extracting an agitator 12 from the tub 14 of a washing machine 16. The device 10 comprises a split annular shaped blader member 18 having a pair of closed ends 20, 22 a hollow chamber therein for receiving pressurized air therein, and an upper 24 and lower 26 surfaces which are distendable upon inflation. Member 18 is formed from a soft flexible material which can be readily expanded upon inflation. Suitable materials for forming member 18 are a flexible rubber type material or a flexible thermoplastic. In the deflated state, member 18 is of a flat washer shaped configuration. In the inflated state, member 18 is of a split toroidial configuration. An eyelet 28 is joined as an integral part to one end 20 of a member 18. A hook element 30 is hingably joined to a tab 31 at the second end 22 of member 18. The hook element 30 engages the eyelet 28 to hold member 18 in a toroidial configuration during inflation. Member 18 has an opening 32 therethrough wherein a valve member 34 having an externally threaded stem 36 extends inwardly in opening 32. A reinforcing collar element 38 secures and seals the valve member 34 to member 18. A pneumatic pressurized line 39 is adapted to be threadably received on stem 36. The other end of line 39 communicates with a pressurizing source 40 such as a foot pump or a conventional bicycle pump.

In use, the deflated member 18 is layed flat on the upper surface of the base 42 of the tub 14 under the lower annular shoulder 44 of the agitator 12. The hook element 30 is engaged into the eyelet 28. Member 18 is inflated whereby the upper surface 24 of the member 18 extends an upward pressure on the lower surface of shoulder 44 and causes the agitator to be forced upwardly for easily extraction.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A pneumatic jack device, which comprises:

a. an agitator having a bottom annular shoulder of a tub of a washing machine;

b. an annular split member having a pair of closed ends, distendable surfaces, an opening through one said surface, and a hollow chamber therein, said member inflatable into a split toroidial shaped configuration, said inflated member frictionally engaging a bottom surface of said annular shoulder of said agitator;

c. an eyelet affixed to one said end of said annular split member;

d. a hook element hingably joined to said other end of said annular split member, said hook element engaging said eyelet to hold said annular split member in said torodial configuration under said annular shoulder of said agitator;

e. a valve member having a stem extending inwardly into said opening of said annular split ring member, said stem being externally threaded;

f. an annular collar sealing said valve member to said annular split ring member;

g. a pressurizing source; and h. a pressurized line threadably engaging said stem and communicating with said pressurizing source.

* * * * *